US005090220A

United States Patent [19]

Fukuzawa et al.

[11] Patent Number: 5,090,220

[45] Date of Patent: Feb. 25, 1992

[54] AUTOMATIC WASHING MACHINE HAVING TUB POSTURE TILTING MECHANISM

[75] Inventors: Sooichi Fukuzawa, Hitachi; Seiichi Hayashi, Yokohama; Etsurou Hirose, Hitachi; Kazue Miyashita, Tokyo, all of Japan

[73] Assignee: Hitachi, Inc., Tokyo, Japan

[21] Appl. No.: 623,027

[22] Filed: Dec. 6, 1990

[30] Foreign Application Priority Data

Dec. 18, 1989 [JP] Japan ..... 1-327582

[51] Int. Cl.[5] ..... D06F 39/00

[52] U.S. Cl. ..... 68/3 R; 68/210; 68/131; 248/550

[58] Field of Search ..... 68/3 R, 210, 131, 25; 248/188.1, 133, 550; 312/276, 120, 123; 134/115, 114

[56] References Cited

U.S. PATENT DOCUMENTS

| | | | |
|---|---|---|---|
| 2,429,090 | 10/1947 | Burt-Wells | 134/114 |
| 3,798,931 | 3/1974 | Czech et al. | 68/3 R |
| 4,526,020 | 7/1985 | Fey et al. | 68/3 R |
| 4,534,188 | 8/1985 | Fey | 68/3 R |
| 4,535,610 | 8/1985 | Fey et al. | 68/3 R |
| 4,785,643 | 11/1988 | Werner | 68/3 R |
| 4,819,459 | 4/1989 | Keith | 68/3 R |

FOREIGN PATENT DOCUMENTS

| | | | |
|---|---|---|---|
| 1155017 | 11/1957 | France | 68/26 |
| 129357 | 9/1950 | Sweden | 68/26 |

*Primary Examiner*—Frankie L. Stinson

*Attorney, Agent, or Firm*—Antonelli, Terry, Stout & Kraus

[57] ABSTRACT

A washing tub and an outer tub are inclined together by a tub posture tilting mechanism. The tub posture tilting mechanism is constituted of a link mechanism structure. One of the tub posture tilting mechanism comprises mainly a pair of beams mounted integrally on the outer tub, a pair of bases mounted turnable on the beams, a crank mounted turnable on a rear base and an arm mounted turnable on the crank and mounted on a motor. The motor is mounted integrally on the rear base and drives the tub posture tilting mechanism. Another of the tub posture tilting mechanism comprises mainly a pair bases mounted turnable on the outer tub, a crank mounted turnable on a rear base and an arm mounted turnable on the crank and mounted turnable on a motor. The motor is mounted integrally on the outer tub and drives the tub posture tilting mechanism. A delicate washing clothes is washed softly in a triangular washing region at a uniform inclined state of the washing tub. The delicate washing clothes is washed softly by a reciprocate move of the washing tub in a variable washing region at a variable inclined state of the washing tub.

28 Claims, 10 Drawing Sheets

AUTOMATIC WASHING MACHINE HAVING TUB POSTURE TILTING MECHANISM

BACKGROUND OF THE INVENTION

The present invention relates to an automatic washing machine having a tub posture tilting mechanism and, more particularly to a full automatic washing machine having a tub posture tilting mechanism suitable for washing softly the delicate washing clothes such as the wool sweater and the lingerie.

The automatic washing machine according to the present invention has a tub posture tilting mechanism for tilting or inclining both of a posture of a washing tub and a posture of an outer tub. The standard washing clothes is washed in the washing tub using a washing liquid at a vertical state of the washing tub and the delicate washing clothes is washed softly in the washing tub using the washing liquid at an inclined state or a tilted posture of the washing tub according to the operation of the tub posture tilting mechanism structure.

In a conventional automatic washing machine, for example disclosed in Japanese Utility Model Laid-Open No. 205482/1986, a barrel-like shape washing tub is supported rotatively in a washing machine main body through a horizontal shaft and a barrel-like outer tub installed rotatively at an outer peripheral portion of the washing tub through another horizontal shaft in the washing machine main body.

The washing tub and the outer tub are rotated together in the washing machine main body through an operation according to a rack gear and pinion gear mechanism structure which is provided on and engaged with the outer peripheral portion of the outer tub. Namely, the washing tub and the outer tub are rotated together in accordance with the rotation of the rack gear and pinion gear mechanism structure.

A tub posture change-over apparatus for the postures of the washing tub and the outer tub or a motor for rotating the outer tub is provided in the washing machine main body. According to an operation of the tub posture change-over apparatus, the postures of the washing tub and the outer tub are changed over at two ways, namely at a vertical state in which another horizontal shaft is positioned at a vertical direction or at a horizontal state in which another horizontal shaft is positioned at a horizontal direction.

In the above stated conventional automatic washing machine, with the condition that both of the postures of the washing tub and the outer tub are maintained at the vertical state according to the operation of the tub posture change-over apparatus, the standard washing process is carried out using a pulsator which is mounted in the washing tub. The standard washing process for the standard washing clothes is carried out with the washing liquid swirling flow caused according to the high speed rotation of the pulsator.

Besides, with the condition that both of the postures of the washing tub and the outer tub are maintained at the horizontal state by the operation of the tub posture change-over apparatus, the washing tub is inclined at the horizontal direction and then the washing tub is rotated with a comparative slow speed. The delicate washing clothes is washed softly in the washing liquid similar to the washing process in a rotative drum type automatic washing machine. This soft washing process for the delicate washing clothes is carried out without the rotation of the pulsator.

Namely, by maintaining the postures of the washing tub and the outer tub at the horizontal state, the delicate washing clothes such as the wool sweater and the lingerie can be washed softly according to the low speed rotation of the inclined washing tub.

Further, by maintaining the postures of the washing tub and the outer tub at the horizontal state, the drying process is carried out according to the rotation of the washing tub.

As stated above, according to the conventional automatic washing machine, by maintaining the postures of the washing tub and the outer tub at the vertical state, the standard washing process suitable for washing the standard washing clothes is carried out by the washing liquid swirling flow using the pulsator.

Further by maintaining the postures of the washing tub and the outer tub at the horizontal state, the washing tub is rotated at the comparative low speed and the delicate washing clothes such as the wool sweater and the lingerie can be washed softly by rotating the washing tub at the comparative slow speed without a strong agitating force by the pulsator. Accordingly, there has a merit in which the delicate washing clothes dispenses with no injury.

However, when the barrel-like shape washing tub and the outer tub are received in the washing machine outer frame, many dead spaces are formed at the corner portions and so that it has a demerit with respect to the space aspect and further it is difficult to mold integrally such a barrel-like shape washing tub having a complicated shape.

Further, it is necessary to position always the turning fulcrum during the rotation for the horizontal state and the vertical state at a center point in the longitudinal cross-section having a substantially circular shape of the washing tub, regardless of the gravitational position of the washing tub.

Therefore, it is not allowed to set the turning fulcrum at the most suitable position which is a gravitational position under the consideration of the vibration-prevention during the spinning process which is a high speed rotation time by the washing tub.

Further, since the longitudinal cross-sectional shape of the washing tub is the substantially circular shape, the rotational axis of the washing tub inclines diversely, accordingly there is a little change in the behavior of the delicate washing clothes and there is little room to improve a cleaning efficiency in the delicate washing clothes.

SUMMARY OF THE INVENTION

An object of the present invention is to provide an automatic washing machine having a tub posture tilting mechanism wherein a high cleaning efficiency with an evenness during a washing process suitable for the delicate clothes can be obtained.

Another object of the present invention is to provide an automatic washing machine having a tub posture tilting mechanism wherein a time during a washing process suitable for the delicate clothes can be shorten.

A further object of the present invention is to provide an automatic washing machine having a tub posture tilting mechanism wherein a mixture and a replacement of the delicate washing clothes during a washing process suitable for the delicate clothes can be carried out more actively.

A further object of the present invention is to provide an automatic washing machine having a tub posture tilting mechanism wherein it is unnecessary for sealing at an opening portion of the washing tub for taking in and taking out a washing material to be washed.

A further object of the present invention is to provide an automatic washing machine having a tub posture tilting mechanism wherein a high productivity for manufacturing the washing tub can be attained.

A further object of the present invention is to provide an automatic washing machine having a tub posture tilting mechanism wherein a highly practical use in a space aspect for the washing tub can be attained.

In accordance with the present invention, in an automatic washing machine comprising a washing tub which receives a washing material to be washed in a washing machine main body and has a pulsator member therein and a driving means for rotating the washing tub and the pulsator member, the washing tub is formed with a cylindrical-like shape having a bottom portion, an opening portion for taking in and taking out the washing material to be washed is formed at an opposite side of the bottom portion of the washing tub, and further the washing tub has a plurality of small holes at a side wall portion.

A rotational axis line of the washing tub is inclined to heighten relatively the opening portion of the washing tub against the bottom portion of the washing tub, and a tub posture tilting mechanism for storing a washing liquid in a triangular cross-sectional shape washing region which is formed according to an inclination of the washing tub.

In accordance with the present invention, an automatic washing machine having a tub posture tilting mechanism comprises a washing machine main body, a washing tub for receiving a washing material to be washed and mounted in the washing machine main body, the washing tub is formed with a cylindrical-like shape having a bottom portion, the washing tub has a pulsator member for agitating the washing material to be washed and a washing liquid and provided at a central portion of the bottom portion thereof, the washing tub provides an opening portion for taking in or taking out the washing material to be washed at an opposite side of the bottom portion thereof and is formed a plurality of small size holes at a side wall portion thereof, an outer tub is provided concentrically on an outer peripheral portion of the washing tub and is formed with a cylindrical-like shape, and a driving apparatus for driving the washing tub and the pulsator member and mounted on an outer bottom portion of the outer tub.

The automatic washing machine comprises further a tub posture tilting mechanism for tilting postures of the washing tub and the outer tub together and mounted on an outer peripheral portion of the outer tub, and a driving apparatus for driving the tub posture tilting mechanism, the tub posture tilting mechanism is inclined with in a range from at a vertical state of the washing tub and the outer tub to a substantially horizontal state of the washing tub and the outer tub and is positioned within an optional angle through an operation of the tub posture tilting mechanism driving apparatus.

The tub posture tilting mechanism driving apparatus is provided on a turning base which is mounted on the outer tub. Namely, the turning base is mounted separately on an outer peripheral portion of the outer tub and thereby the turning base is maintained at the non-movable state with respect to the inclinable outer tub and the inclinable washing tub. The outer tub and the washing tub can tilt or incline around the fixed and non-turnable turning base.

Further, the tub posture tilting mechanism driving apparatus is provided directly on an outer bottom portion of the outer tub. Namely, the tub posture tilting mechanism driving apparatus is mounted directly at the outer tub similar to the washing tub driving apparatus. The tub posture tilting mechanism driving apparatus is maintained at the movable state with respect to the inclinable outer tub and the inclinable washing tub. The tub posture tilting mechanism driving apparatus can turn and incline together with the outer tub and the washing tub.

A rotational center axis of the tub posture tilting mechanism is set to heighten relatively a position of the opening portion of the washing tub than a position of the bottom portion of the washing tub, and a triangular cross-sectional shape washing region is formed at the inner bottom portion and the inner side wall portion of the inclined washing tub, and a washing liquid is stored in the uniform washing region of the inclined washing tub, thereby the delicate washing clothes is washed softly in the uniform washing region of the inclined washing tub according to a rotation of the inclined washing tub at a comparative slow speed.

The washing tub and the outer tub are inclined within a range between a vertical state and a horizontal state and are moved reciprocate according to the tub posture tilting mechanism, and a triangular cross-sectional shape washing region is formed at the inner bottom portion and the inner side wall portion of the inclined washing tub, and the washing liquid is stored in the variable washing region of the inclined washing tub, thereby the delicate washing clothes is washed softly in the variable washing region of the inclined washing tub according to the reciprocative move of the washing tub.

In particular, according to the present invention, the postures of both the outer tub and the washing tub are varied by the operation of the tub posture tilting mechanism. Therefore, two following soft washing process suitable for the delicate washing clothes can be carried out.

One of the soft washing process is carried out in accordance with the maintenance of the postures of the outer tub and the washing tub with a constant optional angle by the operation of the tub posture tilting mechanism. The delicate washing clothes is received in the uniform washing region formed at an inclined inner bottom portion and an inclined inner side wall portion of the washing tub. Thereby the delicate washing clothes is washed softly in the uniform washing region of the inclined washing tub using the washing liquid according to the comparative low speed rotation such as about 50–60 rpm of the inclined washing tub.

Another of the soft washing process is carried out in accordance with the variation the postures of the outer tub and the washing tub within a range of an optional inclined angle by the operation of the tub posture tilting mechanism. The washing tub is moved reciprocative within the range of the inclined angle by the operation of the tub posture tilting mechanism.

The delicate washing clothes is received in the variable washing region formed at an inclined inner bottom portion and an inclined inner side wall portion of the washing tub. The area of the washing region changes according to the posture of the washing tub. Thereby the delicate washing clothes is washed softly in the various kinds of the washing regions of the inclined moving washing tub using the washing liquid according to the reciprocative move of the washing tub.

Therefore, according to the present invention, the washing tub can rotate inclinational. In other words, during the soft washing process according to the low speed rotation of the inclined washing tub, by the inclination of the rotational axis line, since the washing liquid is stored in the washing region which is formed at the inner bottom portion and the inner side wall portion of the inclined washing tub, the necessary and fully washing liquid can be maintained without the leakage of water from the opening portion which needs no sealing member.

Further, by the inclination of the washing tub, the delicate washing clothes moves to shift toward the inclined inner bottom portion and the inclined inner side wall portion having the large washing liquid, the delicate washing clothes is immersed fully always in the washing liquid and the behavior of the delicate washing clothes is varied. Thereby the mixture and the replacement of the delicate washing clothes are carried more actively and the uniform washing and the high cleaning efficiency washing can be carried out.

Further, according to the present invention, when the delicate washing clothes is washed softly with the washing by inclining the washing tub, the washing tub is not maintained entirely at the vertical state. It is unnecessary to form the shape of the washing tub at a barrel-like shape.

Accordingly, as the cylindrical-like shape washing tub is received in the washing machine outer frame, there is no dead space at the corner portions thereof. Therefore, it has an advantage with the respect to the space aspect and it can be solved the problem about the difficulty in the integral molding such as the barrel-like shape washing tub.

Besides, during the soft washing process, the inclining angle of the rotational axis line is varied continuously or intermittently, then the behavior of the whole delicate washing clothes can be made more actively, accordingly a high cleaning efficiency can be obtained and further the washing time can be shortened.

DESCRIPTION OF THE INVENTION

One embodiment of a full automatic washing machine having a tub posture tilting mechanism will be explained referring to the illustrated embodiment shown in drawings according to the present invention.

Figure 1:
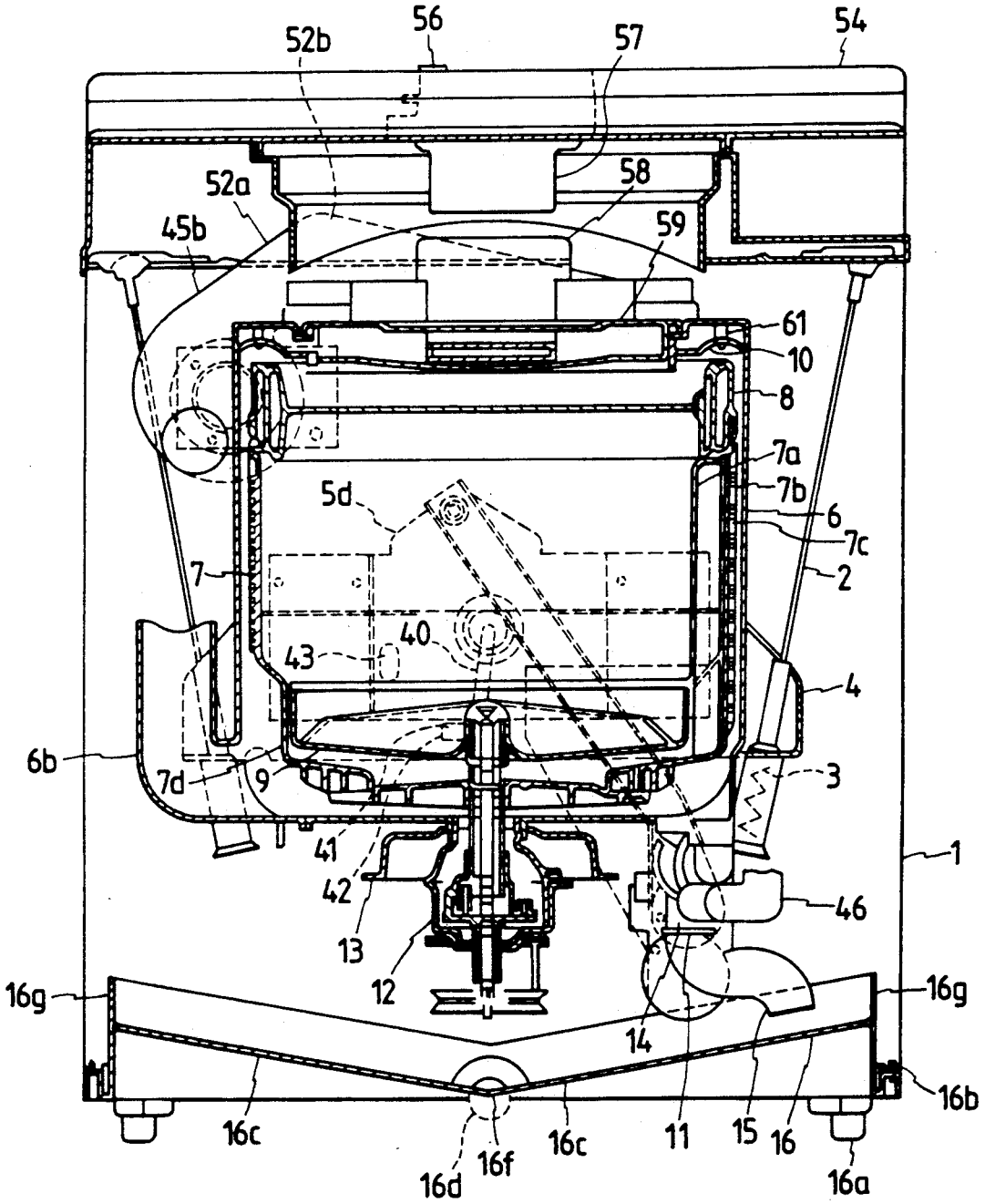
FIG. 1 is a partially and vertically cross-sectional view showing one embodiment of a whole interior structure of an automatic washing machine having a tub posture tilting mechanism taken along a front face of a washing machine main body according to the present invention.

In FIG. 1, in a box-like shape outer frame 1 made of a steel plate material as a washing machine main body, by suspending rods 2 with vibration preventing springs 3, a cylindrical-like shape outer tub 6 is supported through a pair of turning bases 4 so as to prevent vibrantly. A pair of turning beams 5 are fixed integrally to the outer tub 6.

Each of the pair of the turning bases 4 is suspended and supported by the suspending rods 2 at both end portions thereof. One of the pair of the turning bases 4 and one of the pair of the turning beams 5 are positioned at a front side of the washing machine main body 1, respectively. Another of the pair of the turning bases 4 and another of the pair of the turning beams 5 are positioned at a rear side of the washing machine main body 1, respectively. Each of the pair of the turning bases 4 is mounted to cover a lower portion of each of the pair of the turning beams 5.

A washing tub 7 is provided concentrically in the outer tub 6. The washing tub 7 is formed with a vertical cross-sectional shape having a substantially same shape that of the outer tub 6. The cylindrical-like shape washing tub 7 operates a washing process, a spinning process and a drying process of a washing material to be washed, to be spun and to be dried. An upper tip end of the washing tub 7, a balancing weight ring member 8 is installed by a friction fusion or a welding method.

A plurality of longitudinal rib-like lifters 7a for rotating the washing clothes during the drying process are provided in an inner side wall portion of the washing tub 7. A large number of longitudinal grooves 7b are provided with an equal interval between the lifters 7a. A large number of spinning holes 7c are provided on the longitudinal grooves 7b.

At a central portion of an inner bottom portion of the washing tub 7, a dent portion 7d is formed to mount rotatively a pulsator 9, namely maintaining the posture of the washing tub 7 at a vertical state the pulsator 9 carries out the standard washing process for standard washing clothes according to the swirling water flow caused by the rotation of the pulsator 9.

At an upper tip end of the outer tub 6, a tub cover 10 is fixed for preventing the washing material to be washed falling down to a space between the outer tub 6 and the washing tub 7. At an outer bottom portion of the outer tub 6, a water drain apparatus 11 and a driving apparatus 12 for rotating the pulsator 9 and the washing tub 7 are installed through a base member 13 made of a steel plate material. The base member 13 is formed with a box-like shape and fixed to the outer bottom portion of the outer tub 7 by screws etc..

The water drain apparatus 11 comprises a valve member 14 which is connected to an inner bottom portion of the outer tub 6 and a water drain hose 15 which is connected to the valve member 14. One end of the valve member 14 is opened, then the washing liquid is discharged toward a base member 16 which is provided on at a lower portion of the outer frame 1.

The base member 16 has a plurality of legs 16a, a holding portion 16b for holding the outer frame 1, a water receiving portion 16c and a water drain port portion 16d. A central portion 16e of the water receiving portion 16c is constituted to incline toward a central portion 16f of the base member 16.

Thereby, the washing liquid discharged from the water drain hose 15 is made to flow easily toward the center portion 16f and also is discharged easily from the water drain port portion 16d provided on the central portion 16f.

Further, the washing liquid from the water drain port portion 16d is discharged through an attached hose (not shown) to the outside portion of the washing machine main body 1. At an entirely peripheral portion of the water receiving portion 16c, a rib 16g is provided for preventing the water from over-flowing.

Figure 2:
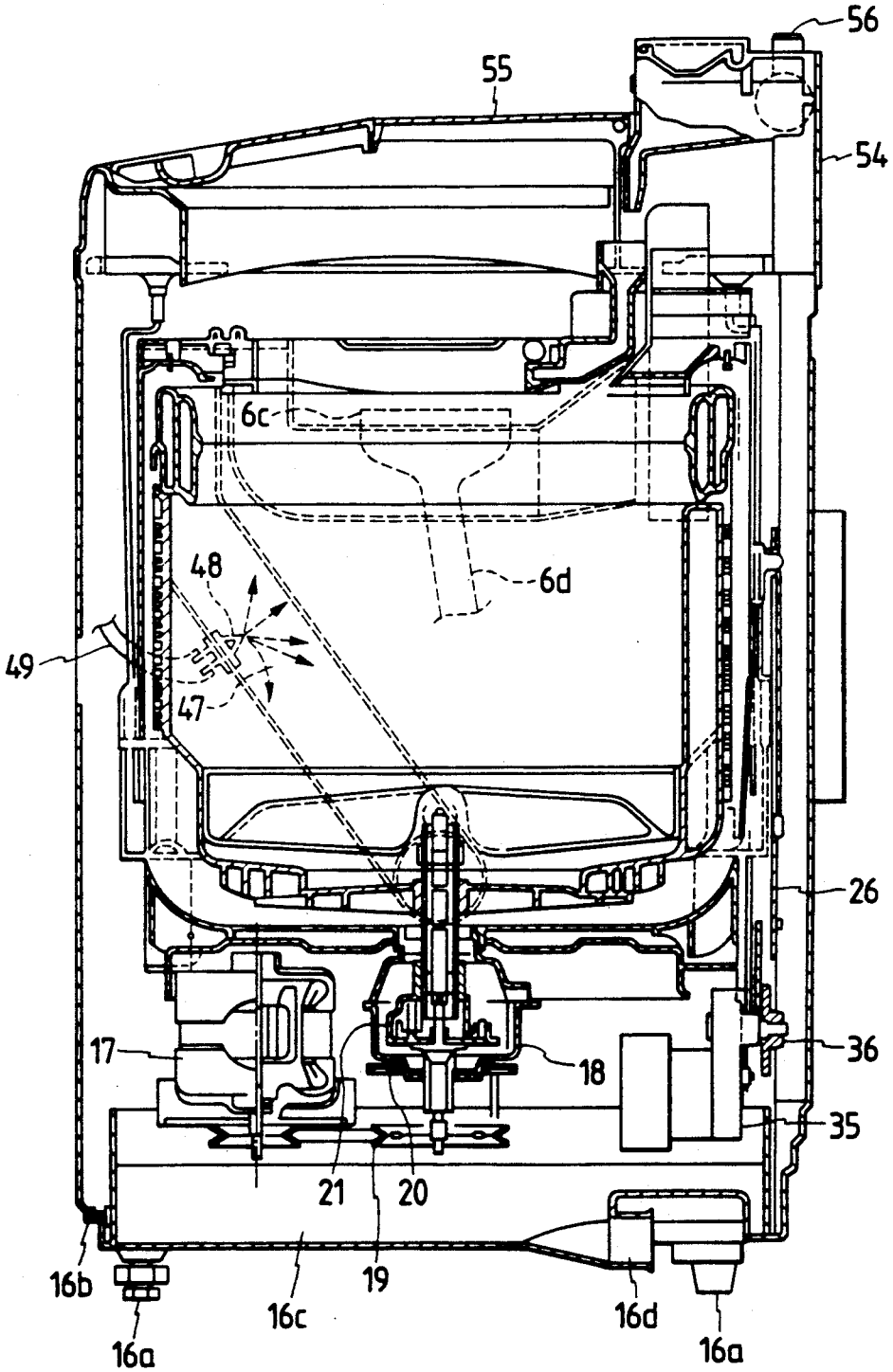
FIG. 2 is a partially and vertically cross-sectional view showing one embodiment of a whole interior structure of an automatic washing machine having a tub posture tilting mechanism taken along a side face of a washing machine main body according to the present invention.

As shown in FIG. 2, the washing tub and pulsator driving apparatus 12 comprises a motor 17, a clutch mechanism 18, a transmitting mechanism 19 for transmitting the rotation of the motor 17 to the clutch mechanism 18, a braking apparatus 20 for braking the rotation of the washing tub 7 and a rotation speed decelerating mechanism 21 for decelerating the rotation of the motor 17 and for transmitting the decelerated rotation of the motor 17 to the pulsator 9.

The arrangement relation between the motor 17 and the clutch mechanism 18 is formed respectively at the front and the rear sides taking from the front face of the washing machine main body 1.

Figure 3:
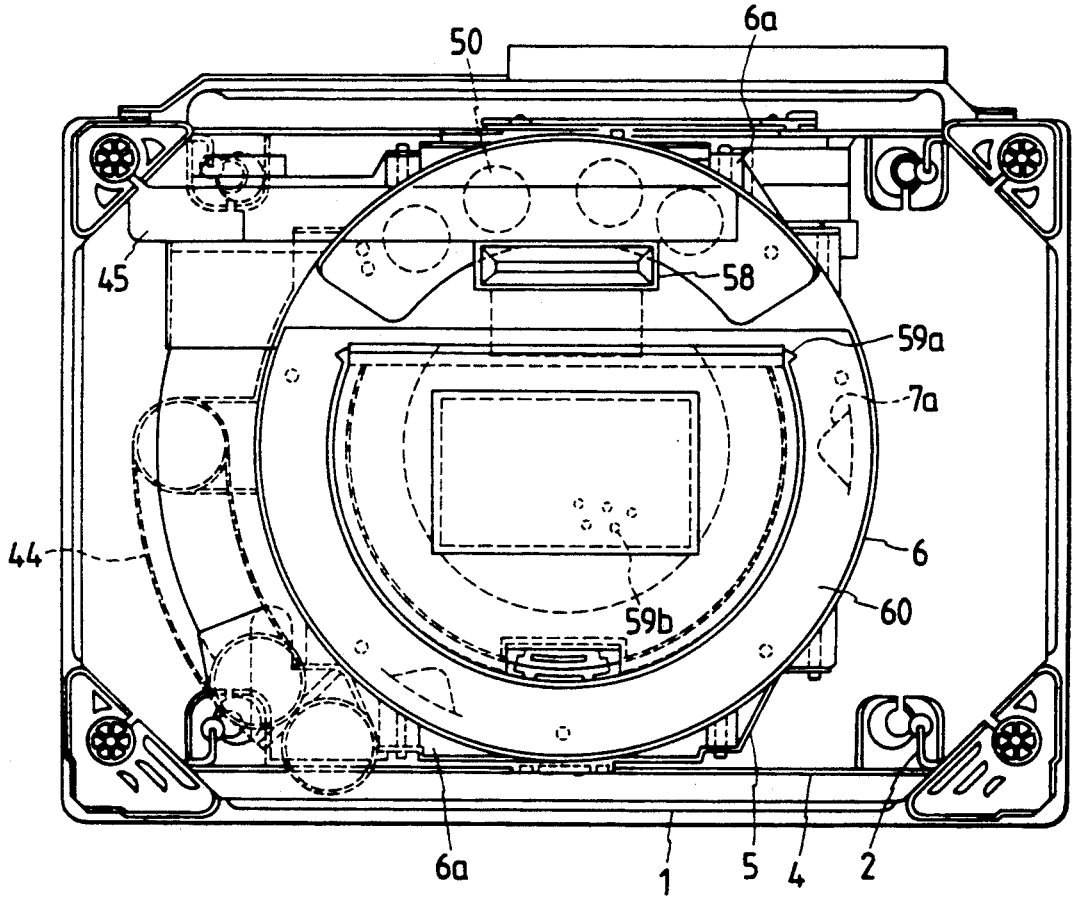
FIG. 3 is a top view showing one embodiment of a whole interior structure of an automatic washing machine having a tub posture tilting mechanism taken along a top face of a washing machine main body according to the present invention, in which a top cover and a lid member are removed for explaining.
Figure 4:
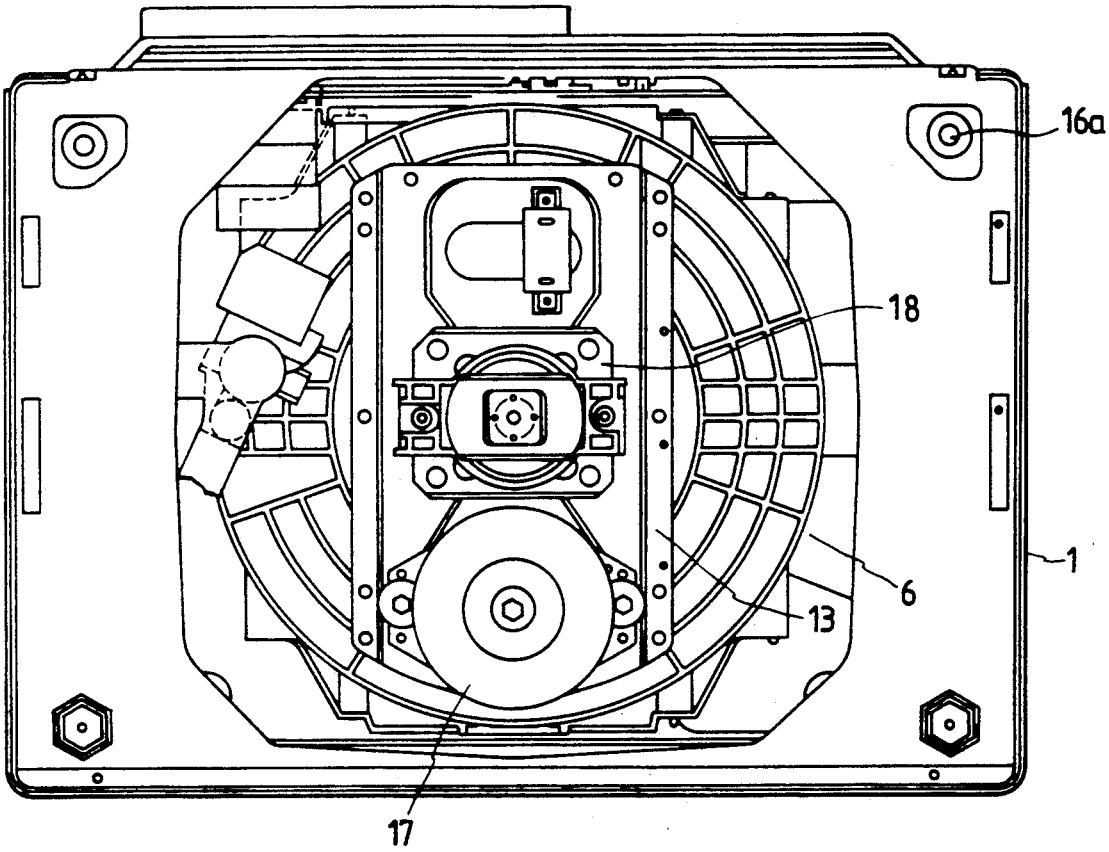
FIG. 4 is a bottom view showing one embodiment of a whole interior structure of an automatic washing machine having a tub posture tilting mechanism taken along a bottom face of a washing machine main body according to the present invention, in which a base member is removed for explaining.
Figure 5:
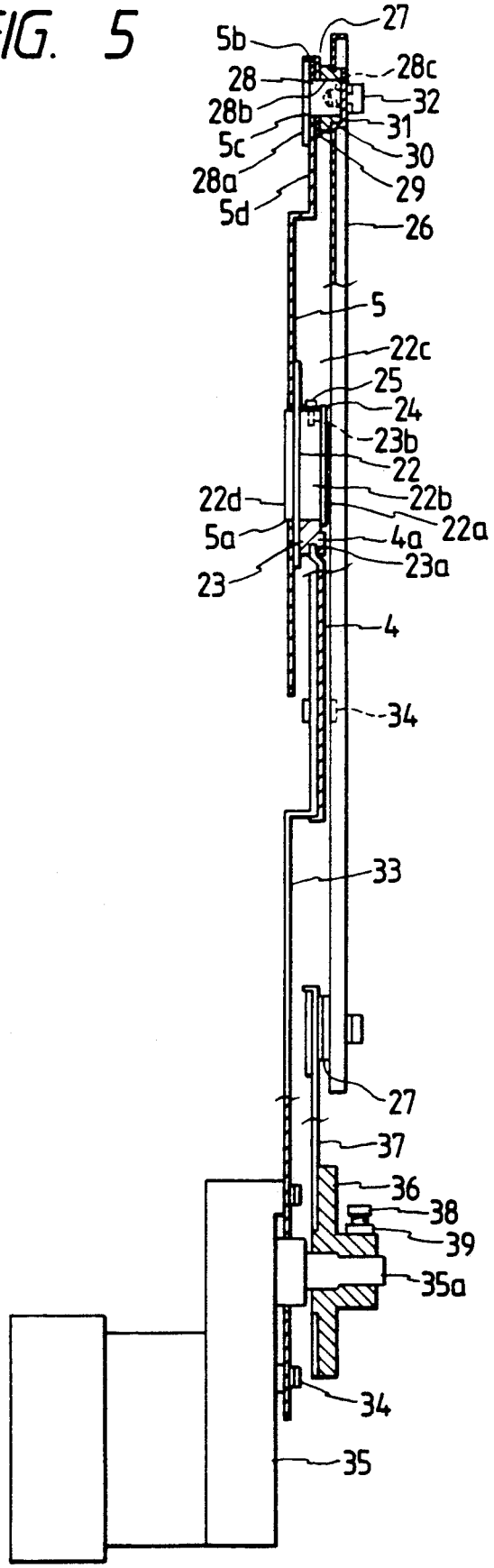
FIG. 5 is an enlarged cross-sectional view showing a vicinity of a link mechanism structure portion of an automatic washing machine having a tub posture tilting mechanism.
Figure 8:
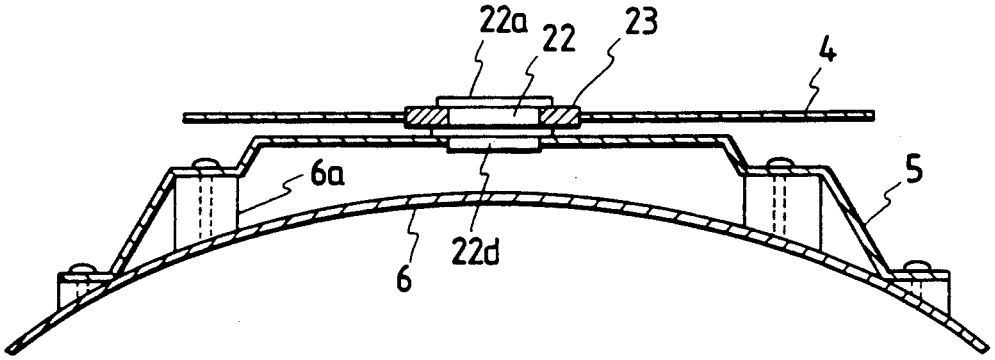
FIG. 8 is a cross-sectional view showing an outer tub in which a turning beam is mounted on the outer tub and a turning base is installed on the turning beam through a shaft.

At two portions of the front and the rear of the outer peripheral portions of the circular-like cross-sectional shape outer tub 6, as shown in FIG. 3, a plurality of mounting bosses 6a are provided and fix the turning beam 5. At a central portion of the pair of the turning beams 5, as shown in FIG. 5 and FIG. 8, a semicircular shape dent portion 5a is provided. A stepped shaft 22 is inserted into this dent portion 5a and is adhered by the welding method etc. as shown in FIG. 5 and FIG. 8.

The stepped shaft 22 comprises a stopper portion 22a, a shaft portion 22b, a fixing ring 22c and a fitting-into portion 22d. At the shaft portion 22b of the stepped shaft 22, an U letter shape bearing member 23 is fitted into as shown in FIG. 5 and FIG. 8. This bearing member 23 comprises a groove 23a at a peripheral portion thereof and screw portions 23b at U letter shape two tip end portions.

An U letter shape dent portion 4a which is provided at a central portion of the turning beam 4 is fitted to at the groove 23a of the bearing member 23. A plate-shape spring member 24 made of an elastic material is fitted to at an upper portion of the groove 23a and fixed by screws 25. Besides, the bearing mechanism structure portion having the above stated construction is provided respectively at two portions, namely at the front and the rear sides of the outer peripheral portion of the outer tub 7.

Metal members 27 are pressure-fixed into both ends of a crank member 26. A crank shaft 28 is inserted rotatively in the metal member 27. The crank shaft 28 comprises a fixing stepped portion 28a at one end thereof, a shaft portion 28b at a central portion and a screw hole 28c at another end thereof. The stepped portion 28a of the crank shaft 28 is constituted integrally with the turning beam 5.

The stepped portion 28a of the crank shaft 28 is mounted on a projecting portion 5d which has a folding portion 5b and a hole 5c and is fixed by welding method. In this crank shaft structure portion, against the shaft portion 28b of the fixed crank shaft 28, the crank member is fastened rotatively by screws 32 through a thrust washer member 29, the metal member 27, a thrust washer member 30 and a washer member 31.

A motor base 33 is fixed integrally to the turning base 4 by screws 34 and at a lower end thereof a turning motor 35 for driving a link mechanism structure is fixed by screws 34 as shown in FIG. 5. An output shaft 35a is provided at the turning motor 35. A boss 36 and an arm member 37, which are provided integrally with, are fixed through screws 38 and a locking nut 39.

The arm member 37 comprises a fixing portion engaged with the boss 36 and the crank shaft structure portion and, similar to the projecting portion 5d of the turning beam 5, a hole (not shown) and a folding portion (not shown) are provided respectively.

In this embodiment of the present invention, the tub posture tilting mechanism structure for the full automatic washing machine comprises mainly a pair of turning beams 5 being fixed to the outer tub 6, a pair of turning bases 4 being supported by the suspending rods 2, the crank member 26 being mounted turnable to the rear side turning base 4 and the arm member 37 being mounted turnable to the crank member 26. The above stated tub posture tilting mechanism is constituted of the link mechanism structure.

The turning beams 5 and the turning bases 4 are mounted on the outer tub 6. The arm member 37 is mounted turnable on the turning motor 35. The turning motor 35 is mounted integrally at a lower portion of the rear turning base 4. This turning motor 35 works a role as the tub posture tilting mechanism driving apparatus.

As shown in FIG. 1, a switch lever 40 is fixed to the stepped shaft 22 by screws etc. and engages with micro-switches 41 and 42 which are fixed respectively to the turning base 4. A duct 44 circulates a hot air during the drying process.

Figure 6:
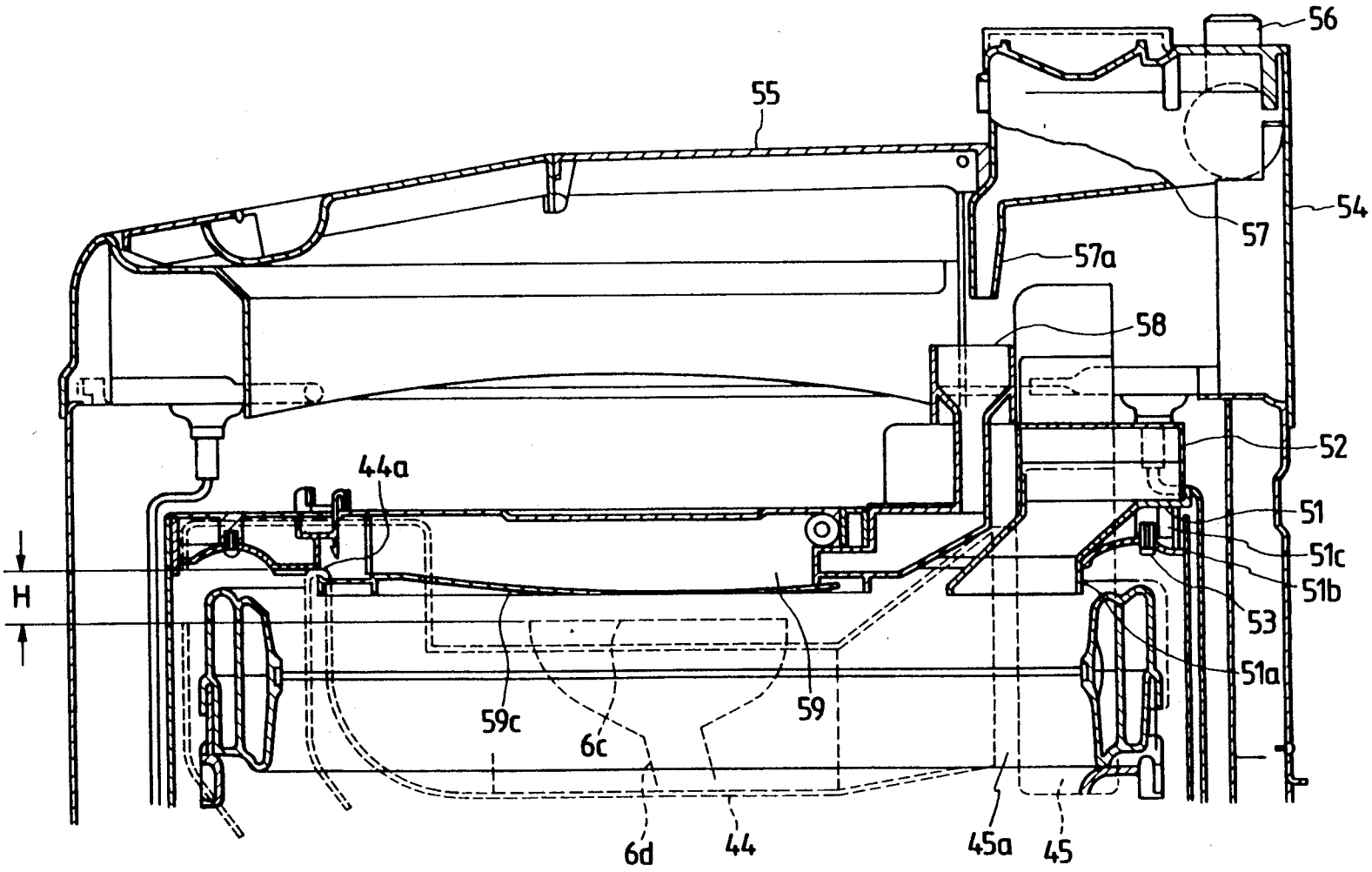
FIG. 6 is an enlarged cross-sectional view showing a vicinity of an over-flow preventing portion of an automatic washing machine having a tub posture tilting mechanism.
Figure 7:
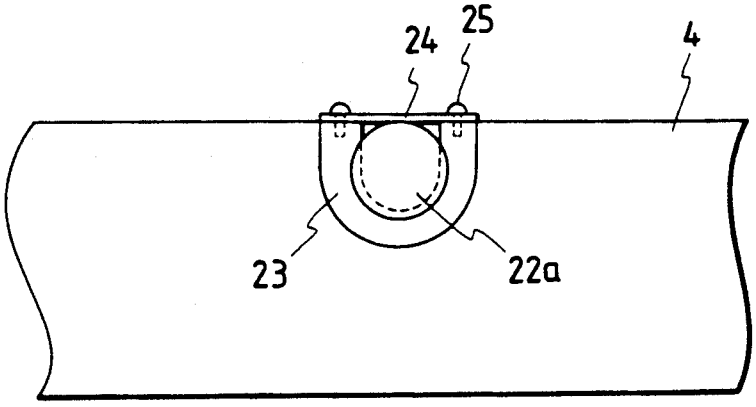
FIG. 7 is a partial plane view showing a turning base having a stepped bearing member and a plate-like shape spring member.

As shown in FIG. 6, one end of the duct 44 is connected with a sealing state to an exhaust air port **6*b* which is provided a left end portion of the lower portion of the outer tub 6. Another end of the duct 44 is connected with a sealing state to a suction port 45*a* of a blower 45**, respectively.

A central inner diameter portion **44*a* of the duct 44 is formed higher with H dimension than an upper end portion of a water over-flow port 6*c* for preventing the over-flow as shown in FIG. 6. The water over-flow port 6*c* is provided integrally with the outer tub 6. Thereby the washing liquid does not flow reversely to a charging portion of a motor for driving the blower 45**.

Besides, a hose portion **6*d* of the water over-flow port 6*c* is connected to a hose 45 of the water drain apparatus 11. The over-flow water is discharged through the water drain hose 15. Further between the connecting portion of the water drain port 6*b* of the duct 44 and the central inner diameter portion 44*a* of the duct 44, as shown in FIG. 2, a nozzle 48 for injecting the water 47 is provided and the nozzle 48 injects the water 47 with a film-like state into the duct 44**.

Namely, during the drying process, so as to prevent the air including the moisture in the washing clothes from circulating, the hot air in the washing tub 7 is introduced into the duct 44. The water 47 is injected to the hot air which passes through into the duct 44 and after the moisture in the hot air is condensed and caught. A water supply hose 49 is connected to the outside city water through a water supply valve member (not shown).

An PTC (Positive Temperature Coefficient) heater 50 is installed with a sealing into a base member 51 and a case 52. A discharge port **45*b* and a connecting port 52*a* of the blower 45 are provided in the case 52. A ventilating space 52*b* for ventilating the hot air is provided at an upper portion of the PTC heater 50**.

A hot air discharging port **51*a* to the washing tub 7 is provided in a central portion of the base member 51. Further, an outer peripheral portion of the base member is contacted internally to the tub cover 10, and a plurality of the bosses 51*c* are provided at a bottom portion of the base member 51 and fixed to the tub cover 10 by screws 53**.

A top cover 54 provides a lid 55 at a central portion and further provides a water supply valve member 56 and a water softener throwing apparatus 57 at a rear portion thereof. A water pouring port **57*a* is provided at a lower portion of the water softener throwing apparatus 57. The water from the water supply valve member 56 is poured into a water receiver 58 which is provided on the base member 51**.

The water receiver 58 is formed with an L letter-like shape and pours the water into an inner lid 59. The inner lid 59 comprises a shaft portion **59*a* which is a fulcrum point during the opening operation or closing operation, a rear lid 59*c* having a plurality of water drain holes 59*b* and a handling portion 59*d*. The inner lid 59 is fitted with a sealing state into a base member 60. The base member 60 is fixed to the tub cover 10 with screws 61**.

In the above stated embodiment of the present invention, the standard washing process for the standard washing clothes for washing such as the sheet and the shirt is carried by the high speed rotation of the pulsator 9.

Namely, both of the outer tub 6 and the washing tub 7 are positioned at the vertical state according to the tub posture tilting mechanism. The standard washing clothes is thrown into the washing tub 7 through the washing clothes taking-in opening portion of the washing tub 7. The washing liquid is introduced and stored in the washing tub 7 and the outer tub 6.

After that, the pulsator 9 is rotated at a high speed rotation such as about 100–120 rpm through the operation of the pulsator driving apparatus 12. Thereby the standard washing clothes is due to the washing liquid swirling flow and the strong agitating force caused through the high speed rotation of the pulsator 9.

In the above stated construction, first of all, the conceptual motion for handling the delicate washing clothes will be explained. Within the washing process and the drying process, the washing and the rinsing of the delicate washing clothes such as the wool sweater or the lingerie are carried out as follows.

Figure 10:
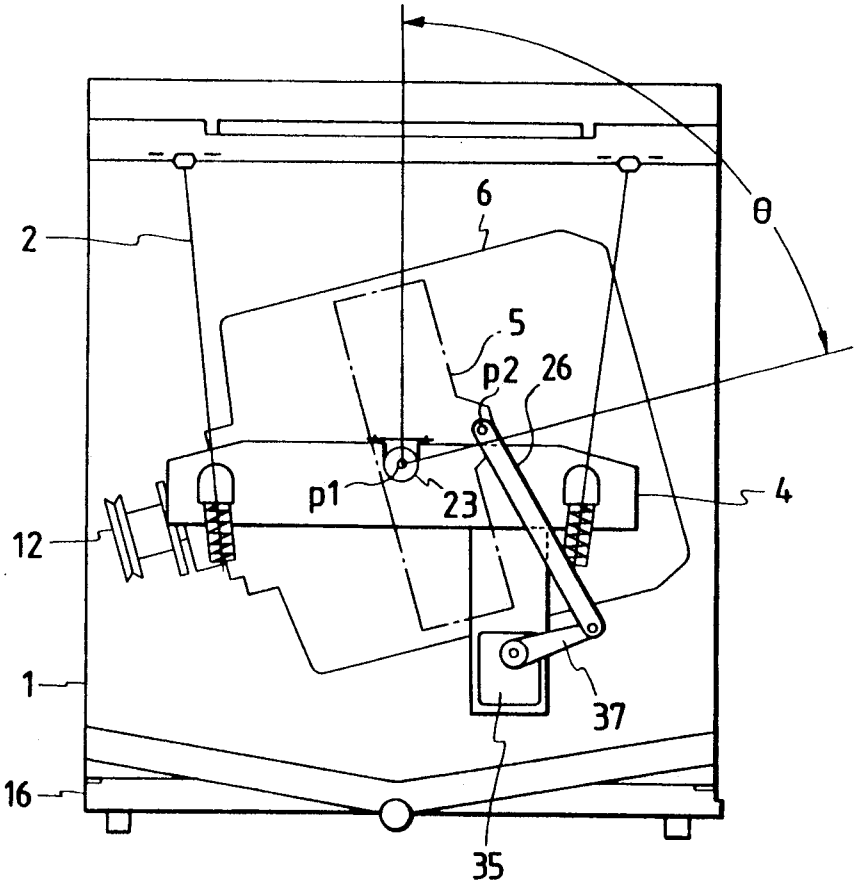
FIG. 10 is an explanatory view showing a condition of using one embodiment of an automatic washing machine having a tub posture tilting mechanism according to the present invention, in which the postures of an outer tub and a washing tub are maintained respectively at an inclined state.
Figure 11:
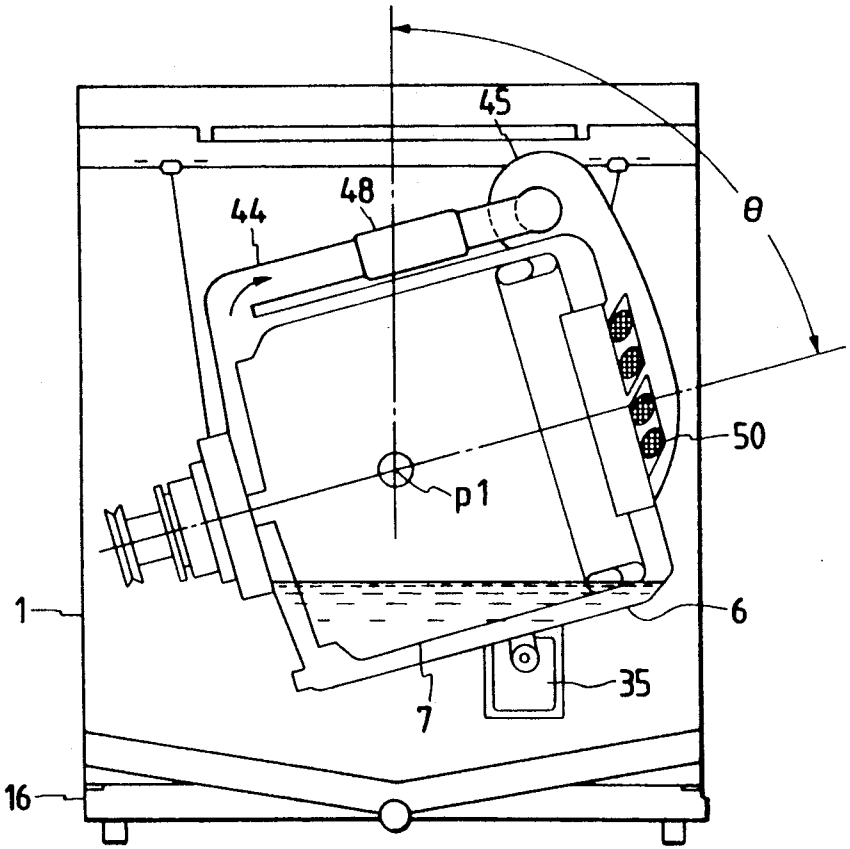
FIG. 11 is an explanatory view showing a condition of using one embodiment of an automatic washing machine having a tub posture tilting mechanism according to the present invention, in which the postures of an outer tub and a washing tub are maintained respectively at an inclined state and the delicate washing clothes is washed in the inclined washing tub.

Namely, as shown in FIG. 10 and FIG. 11, the outer tub 6 and the washing tub 7 are inclined with $\theta$ angle about 0–90 degrees (in this embodiment about 75 degrees) around the fulcrum p1 according to a tub posture tilting mechanism and the washing liquid is stored in a triangular cross-sectional shape washing region, which is formed between the inclined inner bottom portion of the inclined outer tub 6 and the inclined side inner wall portion of the inclined washing tub 7. Then the crank member 26 can turn around the fulcrum p2. Therefore, the soft washing process suitable for the delicate washing clothes is carried out by the rotation of the inclined washing tub 7 such as about 40–60 rpm (in this embodiment about 50 rpm).

After the finish of the washing process, the outer tub 6 and the washing tub 7 are stood upright by the tub posture tilting mechanism and carried out the water draining process and the spinning process. Further, both of the outer tub 6 and the washing tub 7 are rotated inclinational and sideways and carried out the drying process. After that the outer tub 6 and the washing tub 7 are made be stood upright again by the tub posture tilting mechanism and returned at the state shown in FIG. 9, and then one washing cycle is finished.

In this case, the soft washing process according to the rotation of the inclined washing tub 7 is carried out at a fixed or a constant condition having the inclination with $\theta$ angle, however in the soft washing process suitable for the delicate washing clothes within an angle of $\theta$ degree, the inclination of every kind of the washing tub 7 can vary continuously or intermittently and the behavior of the whole delicate washing clothes in the inclined washing tub 7 can be more actively, accordingly a high cleaning effect for the delicate washing clothes can be obtained and the washing time can be shortened.

The washing tub 7 and the outer tub 6 are varied from at a vertical state to a substantially horizontal state by the operation of the tub posture tilting mechanism. Therefore the washing tub 7 and the outer tub 6 are positioned within a constant optional angle according to the tub posture tilting mechanism by the turning motor 35. The delicate washing clothes is received in the uniform washing region of the inclined washing tub 7.

Besides, the washing tub 7 and the outer tub 6 are inclined with an angle about 0–75 degrees (in this embodiment about 0–40 degrees) and swung together by the tub posture tilting mechanism and the washing tub 7 is moved reciprocative according to the tub posture tilting mechanism at about 1–5 seconds (in this embodiment about 2 seconds) per one reciprocating motion.

The delicate washing clothes is washed softly in the washing region of the inclining and moving washing tub 7 according to the reciprocative linear rocking movement of the washing tub 7. In this case, the pulsator 9 in the washing tub 6 and the washing tub 7 itself do not rotate. The soft washing process in this embodiment of the present invention may be called as "a rocking washing process".

Further, in the drying process for the delicate washing clothes similar to the above, in addition to the fixed condition of the inclining or tilting angle, the tilting angle of the washing tub 7 can vary continuously or intermittently within the maximum angle of 90° by the tub posture tilting mechanism, then the hot air warms uniformly the whole delicate washing clothes and the high drying effect can be obtained and further the drying time can be shortened.

Herein, the above stated basic washing motion for the delicate washing clothes in the full automatic washing machine will be explained in more detail. First of all, the lid 55 and the inner lid 59 are opened and the delicate washing clothes in put into the washing tub 7. After the finish of the throwing of the delicate washing clothes, the lid 55 and the inner lid 59 are closed respectively. A bottom "drum type washing course" which is one suitable for washing softly the delicate washing clothes on an operation panel is pushed and a starting bottom is pushed, then the washing and drying cycle for the delicate washing clothes starts.

In this time, just before the soft washing process, the turning motor 35 is supplied the electric current and the outer tub 6 and the washing tub 7 is inclined and tilted with angle and is turned through the tub posture tilting mechanism comprising the above stated link mechanism structure. Namely, when the turning motor 35 turns, the arm member 37 which is fixed integrally with the output shaft 35*a* of the turning motor 35 turns toward p direction shown in FIG. 9 and the crank member 26 is pulled out toward Q direction. According to the above stated motion of the tub posture tilting mechanism structure, the outer tub 6 and the washing tub 7 turn toward R direction around the stepped shaft 22 which is fixed to the turning beam 5.

In this tilt or inclination of the washing tub 7 and the outer tub 6, as shown in FIG. 10, the pair of the turning beams 5 being mounted integrally with the outer tub 7 can turn in company with the washing tub 7 and the outer tub 6. Namely, the pair of the turning beams 5 can turn around the point p1 as the fulcrum, thus the pair of the turning beams 5 can turn with respect the turning bases 4 around the bearing member 23.

However, the pair of the turning bases 4 being supported by the suspending rods 2 cannot move and remain at the fixed position. The turning motor 35 being mounted integrally on the rear turning base 4 cannot move also and remains at the fixed position similar to the turning bases 4.

Figure 9:
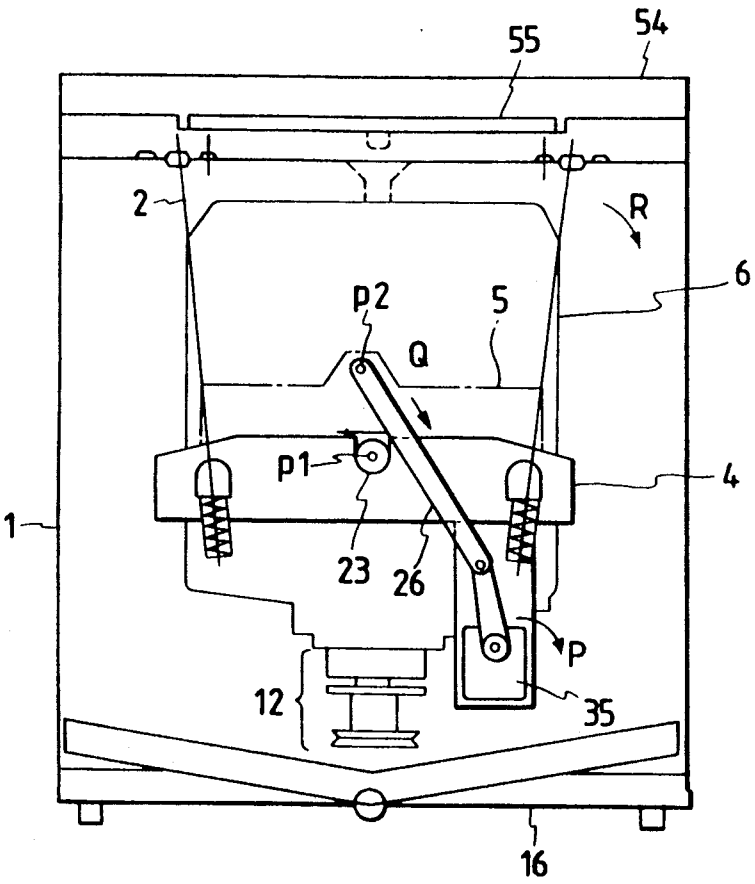
FIG. 9 is an explanatory view showing a condition of using one embodiment of an automatic washing machine having a tub posture tilting mechanism according to the present invention, in which the postures of an outer tub and a washing tub are maintained respectively at a vertical state.

The turning motor 35 stops by the detection of the position detecting sensor and further the turning motor 35 is locked by a motor locking magnet and then the washing liquid suitable for the soft washing process is supplied as shown in FIG. 9. Besides, since the outer tub 6 and the washing tub 7 incline with a tilted angle, the necessary and fully washing liquid is stored in the uniform washing region of the washing tub 7, accordingly there is no leakage of water from the washing clothes taking out port.

Further, during the soft washing process, in accordance with the command from the controlling portion, the lock of the turning motor 35 is released and the inclination of the outer tub 6 and the washing tub 7 can vary continuously or intermittently within a range of $\theta$ angle. Further, during the soft washing process by the rotation of the inclined washing tub 7 the low foam type detergent or the defoaming agent can be supplied automatically.

As clearly shown in the explanation of the illustrated embodiment, according to the present invention, the washing tub 7 can rotate inclinational and sideways by the tub posture tilting mechanism.

In other words, during the soft washing process by the rotation of the inclined washing tub 7, by the inclination of the rotational axis line, since the washing liquid is stored in the washing region which is formed at the inner bottom portion and the inner side wall portion of the inclined washing tub 7, the necessary and fully washing liquid can be maintained without the leakage of water from the opening portion which needs no sealing member.

Further, by the inclination of the washing tub 7, the delicate washing clothes moves to shift toward the inner bottom portion and the inner side wall portion of the inclined washing tub 7 having the large washing liquid, the delicate washing clothes is immersed always the fully washing liquid and the behavior of the delicate washing clothes is changed. Thereby the mixture and the replacement of the delicate washing clothes are carried actively and the uniform washing and the high cleaning efficiency washing can be carried out.

Another embodiment of a full automatic washing machine having a tub posture tilting mechanism according to the present invention will be explained referring to the drawings.

Figure 12:
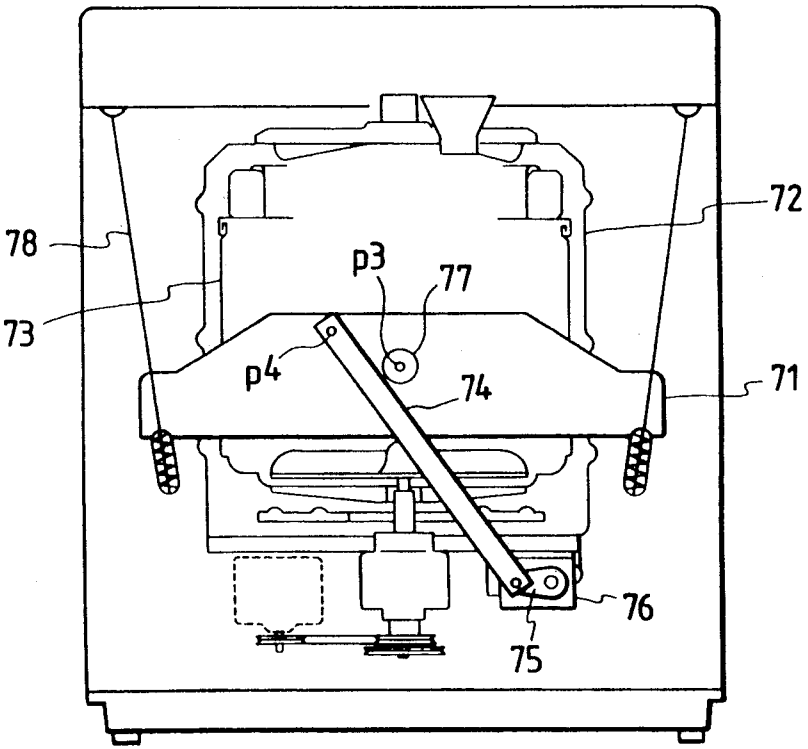
FIG. 12 is an explanatory view showing a condition of using another embodiment of an automatic washing machine having a tub posture tilting mechanism according to the present invention, in which the postures of an outer tub and a washing tub are maintained respectively at a vertical state.

A pair of turning bases 71 are mounted freely on an of a cylindrical-like shape outer tub 72, as shown in FIG. 12. Each of the turning bases 71 is made of a steel metal plate material. The turning bases 71 are disposed at a front side and a rear side of the outer tub 72, respectively. A cylindrical-like shape washing tub 73 is installed in the outer tub 72.

Each of the turning bases 71 is mounted freely at a central point p3 as a fulcrum on the outer peripheral portion of the outer tub 72, respectively. Each of the turning bases 71 is supported only by the fulcrum at the central point p3, respectively. In other words, the outer tub 72 can turn around the fulcrum p3 of each of the turning bases 71.

One end portion of a crank member 74 is mounted on one of the turning base 71 which is positioned at the rear side of the outer tub 72. The crank member 74 is mounted freely on at a point p4 as a fulcrum on the rear turning base 71. In other words, the fulcrum p4 of the crank member 74 is provided on the rear turning base 71 and the fulcrum p4 does not move against the rear turning base 71, however the crank member 74 can turn around the fulcrum p4 on the rear turning base 71.

Another end portion of the crank member 74 is connected to one end portion of an arm member 75. Another end portion of the arm member 75 is connected to a boss provided on a turning motor 76. The turning motor 76 is mounted integrally on a bottom portion of the outer tub 72 and is disposed at a rear side of the outer tub 72.

In this embodiment of the present invention, the tub posture tilting mechanism structure of the full automatic washing machine for tilting the washing tub 73 and the outer tub 72 is comprises mainly the front and rear turning bases 71 being supported by suspending rods 78, the crank member being mounted on the rear turning base 71 and the arm member 75 being mounted turnable on the crank member 74. The above stated tub posture tilting mechanism is constituted of a link mechanism structure.

The turning bases 71 are mounted on the outer peripheral portion of the outer tub 72. The arm member 75 is fixed to the turning motor 76. The turning motor 76 is mounted directly and integrally at an outer bottom portion of the outer tub 72. The turning motor 76 works a role as the driving source the above stated the tub posture tilting mechanism structure.

The washing tub 73 and the outer tub 72 are inclined gradually by the tub posture tilting mechanism according to the force of the turning motor 76. The turning motor 76 can move and turn downwardly in company with the outer tub 72 and the washing tub 73. Namely, the turning motor 76 fixed integrally on the outer tub 72 can move and turn on a circumference around the fulcrum p3.

In accordance with the move of the turning motor 76, both of the crank member 74 and the arm member 75 are leaned by maintaining a distance between the fulcrum p3 of the rear turning base 71 and the fulcrum p4 of the crank member 74 at a constant. The crank member 74 and the arm member 75 are positioned finally as shown in FIG. 13.

Figure 13:
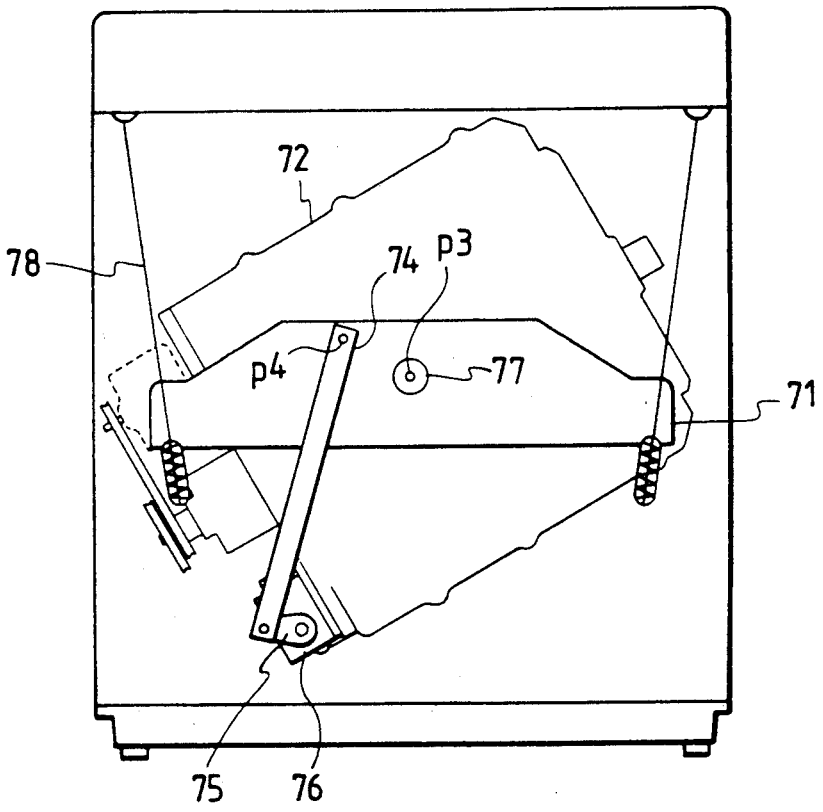
FIG. 13 is an explanatory view showing a condition of using another embodiment of an automatic washing machine having a tub posture tilting mechanism according to the present invention, in which the postures of an outer tub and a washing tub are maintained respectively at an inclined state.

In this case, the washing tub 73 and the outer tub 72 can tilt as shown in FIG. 13. Namely, the washing tub 73 and the outer tub 72 can turn around a bearing member 77 as the rotational center and can turn also around the point p3 as the fulcrum. Thus the washing tub 73 and the outer tub 72 can turn with respect the turning bases 71.

The turning motor 76 being mounted integrally on the outer tub 72 can move also downwardly in the washing machine main body in company with the outer tub 72. Besides, the pair of the turning bases 71 being supported by the suspending rods 78 cannot move and remain at the fixed position.

In this embodiment of the present invention, according to the operation of the tub posture tilting mechanism being constituted by the link mechanism structure, the soft washing process suitable for the delicate washing clothes can be carried out two ways similar to the former embodiment of the present invention.

Namely, the soft washing process using the comparative low speed rotation of the washing tub having the uniform washing region at the uniform inclined state of the washing tub, and the soft washing process using the reciprocate move of the washing tub having the variable washing region at the variable inclined stated of the washing tub can be carried out.

Accordingly, the washing tub 73 and the outer tub 72 are inclined with a predetermined inclined angle and at a predetermined position for washing softly the delicate washing clothes.

Further, according to the present invention, when the delicate washing clothes is washed softly with the washing by inclining the washing tub 73, the washing tub 73 is not maintained entirely at the vertical state. It is unnecessary to form the shape of the washing tub 73 at a barrel-like shape.

Accordingly, as the cylindrical-like shape washing tub 73 is received in the washing machine main body, there are not many dead spaces at the corner portions. Therefore, it has an advantage with the respect to the space aspect and it can be solved the problem about the difficulty in the integral molding such as the barrel-like shape washing tub.

Besides, during the soft washing process, the inclination angle of the rotational axis line of the washing tub 73 is varied continuously or intermittently, then the behavior of the whole delicate washing clothes can be made more actively, accordingly a high cleaning effect for the delicate washing clothes can be obtained and further the washing time in the soft washing process can be shortened.

As stated above, to sum up, according to the present invention, the washing tub 73 can rotate by inclining according to the tub posture tilting mechanism, and when the delicate washing clothes such as the wool sweater and the lingerie is washed softly, therefore it is unnecessary to seal the opening portion for taking in and taking out the delicate washing clothes.

Further, the productivity of the cylindrical-like shape washing tub 73 is good and has an advantage in the space aspect in comparison with the barrel-like shape washing tub, and the mixture and the replacement of the delicate washing clothes during the soft washing process can be made more actively. Accordingly the automatic washing machine having an uniform washing and a high cleaning efficiency for the delicate washing clothes can be provided.

We claim:

1. An automatic washing machine having a tub posture tilting mechanism comprising;

a washing machine main body, a washing tub for receiving a washing material to be washed and mounted in said washing machine main body, said washing tub is formed with a cylindrical-like shape having a bottom portion, said washing tub has a pulsator member for agitating the washing material to be washed and a washing liquid and provided at a central portion of said bottom portion of said washing tub, said washing tub provides an opening portion for taking in or taking out the washing material to be washed at an opposite side of said bottom portion thereof and is formed a plurality of small size holes a side wall portion thereof, an outer tub provided concentrically on an outer peripheral side of said washing tub and is formed with a cylindrical-like shape, and a driving apparatus for driving said washing tub and said pulsator member and mounted on a bottom portion of said outer tub, wherein a tub posture tilting mechanism for tilting postures of said washing tub and said outer tub together and mounted on an outer peripheral portion of said outer tub, and a driving apparatus for driving said tub posture tilting mechanism, said tub posture tilting mechanism is inclined from at a vertical state of said washing tub and said outer tub to a substantially horizontal state of said washing tub and said outer tub and positioned within an optional angle through an operation of said tub posture tilting mechanism driving apparatus, a rotational center axis of said tub posture tilting mechanism is set to heighten relatively a position of said opening portion of said washing tub than a position of said bottom portion of said washing tub, and a triangular cross-sectional shape washing region is formed at an inner bottom portion and a side inner wall portion of said inclined washing tub, and a washing liquid is stored in said washing region of said inclined washing tub, thereby a delicate washing clothes is washed softly in said washing region of said inclined washing tub according to a rotation of said inclined washing tub at a comparative slow speed.

2. An automatic washing machine having a tub posture tilting mechanism according to claim 1, wherein the washing machine comprises further a means for varying continuously an inclining angle of said tub posture tilting mechanism during a soft washing process.

3. An automatic washing machine having a tub posture tilting mechanism according to claim 1, wherein the washing machine comprises further a means for varying intermittently an inclining angle of said tub posture tilting mechanism during a soft washing process.

4. An automatic washing machine having a tub posture tilting mechanism according to claim 1, wherein said washing tub and said outer tub are inclined together with an angle about 0–90 degrees by an operation of said tub posture tilting mechanism.

5. An automatic washing machine having a tub posture tilting mechanism according to claim 1, wherein during the soft washing process said washing tub is rotated at about 40–60 rpm.

6. An automatic washing machine having a tub posture tilting mechanism according to claim 1, wherein said tub posture tilting mechanism comprises mainly a link structure mechanism.

7. An automatic washing machine having a tub posture tilting mechanism according to claim 6, wherein said tub posture tilting mechanism comprises mainly a beam member provided at said outer peripheral portion of said outer tub, a base member provided at said outer peripheral portion of said outer tub, a crank member connected turnable to said base member and an arm member mounted turnable to said crank member, and said arm member of said tub posture tilting mechanism is mounted turnable to said tub posture tilting mechanism driving apparatus.

8. An automatic washing machine having a tub posture tilting mechanism according to claim 7, wherein said tub posture tilting mechanism driving apparatus has an output shaft member, and said base member of said tub posture tilting mechanism is connected turnable to said output shaft member of said tub posture tilting mechanism driving apparatus.

9. An automatic washing machine having a tub posture tilting mechanism according to claim 7, wherein said tub posture tilting mechanism driving apparatus is mounted on said base member of said tub posture tilting mechanism.

10. An automatic washing machine having a tub posture tilting mechanism according to claim 9, wherein said base member of said tub posture tilting mechanism is supported by suspending rod members, said beam member of said tub posture tilting mechanism is mounted integrally on said outer tub, thereby said beam member of said tub posture tilting mechanism turns in company with said outer tub and said washing tub but said base member of said tub posture tilting mechanism remains at a fixed position according to an operation of tub posture tilting mechanism.

11. An automatic washing machine having a tub posture tilting mechanism according to claim 10, wherein said base member and said beam member of said tub posture tilting mechanism are connected through a bearing member, thereby said beam member of said tub posture tilting mechanism can turn around said bearing member.

12. An automatic washing machine having a tub posture tilting mechanism according to claim 7, wherein said tub posture tilting mechanism comprises mainly a base member provided turnable on said outer peripheral portion of said outer tub, a crank member connected turnable to said base member and an arm member mounted turnable to said crank member, and said arm member of said tub posture tilting mechanism is mounted turnable to said tub posture tilting mechanism driving apparatus.

13. An automatic washing machine having a tub posture tilting mechanism according to claim 12, wherein said tub posture tilting mechanism driving apparatus is mounted integrally on said outer tub.

14. An automatic washing machine having a tub posture tilting mechanism according to claim 13, wherein said base member of said tub posture tilting mechanism is supported by suspending rod members and is mounted integrally on said outer peripheral portion of said outer tub, thereby said outer tub and said washing tub turn but said base member of said tub posture tilting mechanism remains at a fixed position according to an operation of said tub posture tilting mechanism.

15. An automatic washing machine having a tub posture tilting mechanism according to claim 14, wherein said base member of said tub posture tilting mechanism is connected turnable to said outer tub through a bearing member, thereby said washing tub and said outer tub can turn around said base member of said tub posture tilting mechanism at said bearing member.

16. An automatic washing machine having a tub posture tilting mechanism comprising;

a washing machine main body, a washing tub for receiving a washing material to be washed and mounted in said washing machine main body, said washing tub is formed with a cylindrical-like shape having a bottom portion, said washing tub has a pulsator member for agitating the washing material to be washed and a washing liquid and provided at a central portion of said bottom portion of said washing tub, said washing tub provides an opening portion for taking in or taking out the washing material to be washed at an opposite side of said bottom portion thereof and is formed a plurality of small size holes a side wall portion thereof, an outer tub provided concentrically on an outer peripheral side of said washing tub and is formed with a cylindrical-like shape, and a driving apparatus for driving said washing tub and said pulsator member and mounted on a bottom portion of said outer tub, wherein a tub posture tilting mechanism for tilting postures of said washing tub and said outer tub together and mounted on an outer peripheral portion of said outer tub, and a driving apparatus for driving said tub posture tilting mechanism, said tub posture tilting mechanism is inclined from at a vertical state of said washing tub and said outer tub to a substantially horizontal state of said washing tub and said outer tub and positioned within an optional angle through an operation of said tub posture tilting mechanism driving apparatus, said washing tub and said outer tub are inclined within a range between a vertical state and a horizontal state and are moved reciprocate according to said tub posture tilting mechanism, and a triangular cross-sectional shape washing region is formed at an inner bottom portion and a side inner wall portion of said inclined washing tub, and the washing liquid is stored in said washing region of said washing tub, thereby a delicate washing clothes is washed softly in said variable washing region of said inclined washing tub according to the reciprocative move of said washing tub.

17. An automatic washing machine having a tub posture tilting mechanism according to claim 16, wherein a range of said reciprocating move of said washing tub and said outer tub is defined from a vertical state of said washing tub and said outer tub to an inclined state of said washing tub and said outer tub of about 0–70 degrees according to an operation of said tub posture tilting mechanism.

18. An automatic washing machine having a tub posture tilting mechanism according to claim 16, wherein said washing tub is moved reciprocate at about 1–5 seconds per one reciprocating motion according to an operation of said tub posture tilting mechanism.

19. An automatic washing machine having a tub posture tilting mechanism according to claim 18, wherein said tub posture tilting mechanism comprises mainly a beam member provided at said outer peripheral portion of said outer tub, a fix member fixed to said beam member with said outer tub, a base member fitted to said fixing member, a crank member connected to said base member and an arm member mounted to said crank member, and said arm member of said tub posture tilting mechanism is mounted to said tub posture tilting mechanism driving apparatus.

20. An automatic washing machine having a tub posture tilting mechanism according to claim 16, wherein said tub posture tilting mechanism during apparatus has an output shaft member, and said base member of said tub posture tilting mechanism is connected to said output shaft member of said tub posture tilting mechanism driving apparatus.

21. An automatic washing machine having a tub posture tilting mechanism according to claim 16, wherein said tub posture tilting mechanism comprises mainly a link structure mechanism.

22. An automatic washing machine having a tub posture tilting mechanism according to claim 16, wherein said tub posture tilting mechanism driving apparatus is mounted on said base member of said tub posture tilting mechanism.

23. An automatic washing machine having a tub posture tilting mechanism according to claim 22, wherein said base member of said tub posture tilting mechanism is supported by suspending rod members, said beam member of said tub posture tilting mechanism is mounted integrally on said outer tub, thereby said beam member of said tub posture tilting mechanism turns in company with said outer tub and said washing tub but said base member of said tub posture tilting mechanism remains at a fixed position according to an operation of tub posture tilting mechanism.

24. An automatic washing machine having a tub posture tilting mechanism according to claim 23, wherein said base member and said beam member of said tub posture tilting mechanism are connected through a bearing member, thereby said beam member of said tub posture tilting mechanism can turn around said bearing member.

25. An automatic washing machine having a tub posture tilting mechanism according to claim 16, wherein said tub posture tilting mechanism comprises mainly a base member provided turnable on said outer peripheral portion of said outer tub, a crank member connected turnable to said base member and an arm member mounted turnable to said crank member, and said arm member of said tub posture tilting mechanism is mounted turnable to said tub posture tilting mechanism driving apparatus.

26. An automatic washing machine having a tub posture tilting mechanism according to claim 25, wherein said tub posture tilting mechanism driving apparatus is mounted integrally on said outer tub.

27. An automatic washing machine having a tub posture tilting mechanism according to claim 26, wherein said base member of said tub posture tilting mechanism is supported by suspending rod members and is mounted integrally on said outer peripheral portion of said outer tub, thereby said outer tub and said washing tub turn but said base member of said tub posture tilting mechanism remains at a fixed position according to an operation of said tub posture tilting mechanism.

28. An automatic washing machine having a tub posture tilting mechanism according to claim 27, wherein said base member of said tub posture tilting mechanism is connected turnable to said outer tub through a bearing member, thereby said washing tub and said outer tub can turn around said base member of said tub posture tilting mechanism at said bearing member.

* * * * *